United States Patent [19]

Tietjens

[11] Patent Number: 4,577,408

[45] Date of Patent: Mar. 25, 1986

[54] HAIR-CUTTING DEVICE

[75] Inventor: Eduard W. Tietjens, Drachten, Netherlands

[73] Assignee: U.S. Philips Corporation, New York, N.Y.

[21] Appl. No.: 559,515

[22] Filed: Dec. 8, 1983

[30] Foreign Application Priority Data

Dec. 13, 1982 [NL] Netherlands ..... 8204808

[51] Int. Cl.[4] ..... B26B 19/06

[52] U.S. Cl. ..... 30/222; 30/43.92; 30/210

[58] Field of Search ..... 30/213, 214, 221, 222, 30/267, 43.2, 43.9, 43.92, 210

[56] References Cited

U.S. PATENT DOCUMENTS 3,218,710 11/1965 Bruck ..... 30/222
3,623,223 11/1971 Edgell et al. ..... 30/222 X
3,869,790 3/1975 Ihasz ..... 30/43.92

FOREIGN PATENT DOCUMENTS 7512633 5/1977 Netherlands .

*Primary Examiner*—Douglas D. Watts
*Attorney, Agent, or Firm*—Rolf E. Schneider

[57] ABSTRACT

A hair-cutting device comprises a stationary cutter; and a drivable cutter reciprocatingly movable with respect to the stationary cutter, each cutter being provided with teeth extending substantially at right angles to the driving direction. Each tooth of the drivable cutter is formed at the free end of a flexible arm, the respective flexible arms being spaced from each other to provide a slot between each pair of adjacent flexible arms. A rigid pressure element is located adjacent to and within the range of elastic deflection of the free ends of the respective flexible arms. The opposite end of each flexible arm is connected to a common cutter beam, the respective flexible arms and the cutter beam being integrally formed in one piece from a flexible sheet material.

1 Claim, 4 Drawing Figures

HAIR-CUTTING DEVICE

This invention relates to a hair-cutting device having a cutter which is adapted to be driven with a reciprocating movement with respect to a stationary cutter, both cutters being provided with teeth directed substantially at right angles to the driving direction.

Such a cutting device is known, for example, from published Dutch Patent Application No. 7512633. In order to obtain a satisfactory cutting action, it is necessary for the drivable or movable cutter to be pressed against the stationary cutter so that during cutting the movable cutter is not pushed away from the stationary cutter by the forces thereby produced. However, when the two cutters are pressed against each other, disadvantageous effects occur, such as friction losses, wear and the developement of heat.

The present invention has for its object to eliminate these disadvantages and provides a construction which is characterized in that each tooth of the movable cutter is located at the free or flexible end of an elastic arm and a pressure element is provided which is located adjacent to and within the range of elastic deflection of the free ends of the respective arms.

During a cutting operation, the movable teeth are supported by the pressure element. If such teeth are not loaded during driving, it slides over the stationary cutter with only a very small pressure force produced by a small deformation of the elastic arms. As a result, the friction losses and other undesirable effect are considerably reduced.

A particular embodiment is characterized in that the pressure element is located in part between two adjacent elastic arms and is provided on both sides with oblique pressure surfaces.

A practical embodiment is characterized in that the movable cutter is provided with a common cutter beam to which the elastic arms are connected at their ends remote from the teeth, and in that said beam and the arms are made in one piece from an elastic or flexible sheet material.

Figure 1:
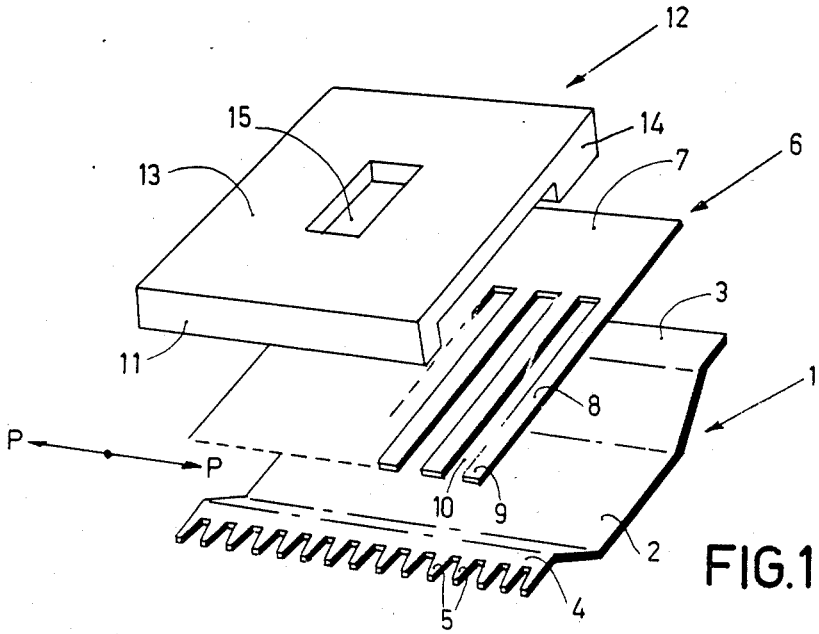
Figure 2:
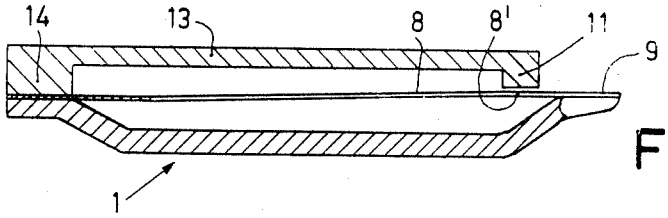
Figure 3:
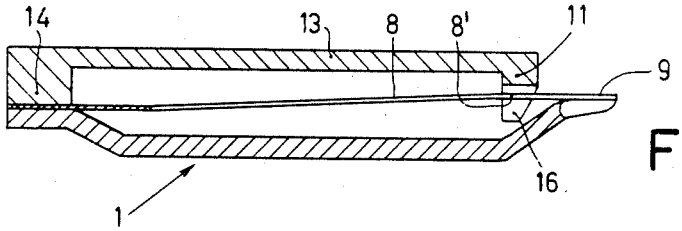
Figure 4:
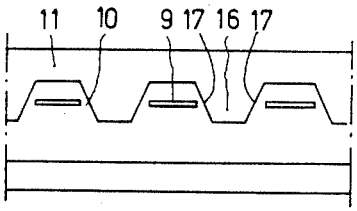

The invention will now be explained with reference to the accompanying drawings, in which:

FIG. 1 is a perspective and exploded view of the drivable cutter with the pressure element and the stationary cutter, FIG. 2 is a cross-sectional view of the component parts of FIG. 1 in the assemble state, FIG. 3 is a cross-sectional view, similar to that of FIG. 2, of another embodiment, and FIG. 4 is a partial front elevation on an enlarged scale of the embodiment shown in FIG. 3.

In the embodiment shown in FIGS. 1 and 2, the stationary cutter 1 is in the form of a shallow trough-shaped body 2 with flanges 3 and 4. The flange 4 is provided with teeth 5. The movable cutter 6 comprises a cutter beam 7 having elastic arms 8 formed with teeth 9 at their free ends. The elastic arms with the teeth are separated from one another by slots 10. The two cutters 1 and 6 are each made in one integral piece from an elastic or flexible sheet material.

A common rigid pressure element 11 for the teeth 9 forms part of a pressure member 12 having a central part 13 and a supporting beam 14. The central part 13 is provided with a coupling aperture 15 for coupling the pressure member 12 to a driving mechanism known per se for reciprocation thereby in the directions P.

The supporting beam 14 is fixedly connected to the cutter beam 7 so that the pressure element 11 and the movable cutter 6 are driven together with a reciprocating movement with respect to the stationary cutter 1. The dircection of the reciprocating movement is substantially at right angles to the longitudinal direction of the teeth.

If a tooth 9 meets an object that has to be cut, for example, a hair, such tooth will be pushed away by the reaction forces exerted by object on the tooth. After a small elastic deflection, the part 8′ of the arm 8 adjoining the tooth will engage the pressure element 11. Since the pressure element is rigid and the effective length of the elastic arm of the tooth is thus considerably shortened, the tooth 9 will not deflect further and the object is cut. If the tooth 9 does not meet an object that has to be cut, the tooth will engage the stationary cutter with only a very small force produced by a small elastic bending of the elastic arm 8.

In the embodiment shown in FIGS. 3 and 4, the pressure element 11 is formed with protrusions 16 which project one through each of the slots 10 between the arms 8 in the region of the parts 8′ of the arms, and each of which has two converging oblique pressure surfaces 17. The elastic arms are also flexible in the driving directions P, so that when one of the teeth 9 meets a hair, the tooth will deflect in one of the directions P until the arm part 8′ adjoining that tooth engages the adjacetn oblique pressur surface 17 towards which the tooth is deflected. Further deflection of the tooth is thus prevented, while the oblique pressure surface 17 will also exert a reaction force on the tooth 9 in the direction of the stationary cutter so that the hair will be cut again.

The embodiment described above have the advantages that only a small amount of power is required for driving the movable cutter due to the small pressure force between the cutters, while disadvantageous effects, such as wear and developement of heat, are now substantially completely avoided.

What is claimed is:

1. A hair-cutting devicd comprising a stationary cutter; a drivable cutter reciprocatingly movable with respect to the stationary cutter, each cutter being provided with teeth extending substantially at right angles to the driving direction; each tooth of the drivable cutter being formed at the free end of a flexible arm, the respective flexible arms being spaced from each other to provide a slot between each pair of adjacent flexible arms; a rigid pressure element located adjacent to and within the range of elastic deflection of the free ends of the respective flexible arms; and protrusions formed on the rigid pressure element and respectively extending into the slots between the pairs of adjacent flexible arms, each protrusion having two converging oblique pressure surfaces for engagement by said flexible arms upon deflection thereof; the opposite end of each flexible arm being connected to a common cutter beam, the respective flexible arms and the cutter beam being integrally formed in one piece from a flexible sheet material.

* * * * *